US009669282B2

(12) United States Patent
Salinas

(10) Patent No.: US 9,669,282 B2
(45) Date of Patent: Jun. 6, 2017

(54) BASEBALL GLOVE AND LINER

(71) Applicant: Jose A. Salinas, Corpus Christi, TX (US)

(72) Inventor: Jose A. Salinas, Corpus Christi, TX (US)

( * ) Notice: Subject to any disclaimer, the term of this patent is extended or adjusted under 35 U.S.C. 154(b) by 249 days.

(21) Appl. No.: 13/998,574

(22) Filed: Nov. 12, 2013

(65) Prior Publication Data

US 2014/0208478 A1 Jul. 31, 2014

Related U.S. Application Data

(60) Provisional application No. 61/849,407, filed on Jan. 28, 2013, provisional application No. 61/852,970, filed on Mar. 26, 2013.

(51) Int. Cl.
*A63B 71/00* (2006.01)
*A63B 71/14* (2006.01)
*A63B 69/00* (2006.01)

(52) U.S. Cl.
CPC ..... *A63B 71/143* (2013.01); *A63B 2069/0011* (2013.01)

(58) Field of Classification Search
CPC ... A63B 71/143; A63B 71/141; A63B 71/146; A63B 71/14; A63B 71/148; A63B 2069/0011; A41D 19/015; A41D 19/01547; A41D 19/00; A41D 19/001; A41D 19/0058; A41D 13/08; A41D 13/015; A41D 13/081; A41D 13/05; A41D 13/0156; A41D 13/0015; A41D 13/082
USPC ..... 2/19, 20, 159, 161.1, 161.2, 161.6
See application file for complete search history.

(56) References Cited

U.S. PATENT DOCUMENTS

| | | | | |
|---|---|---|---|---|
| 2,258,999 | A | 11/1941 | Nunn | |
| RE24,610 | E | 2/1959 | Denkert | |
| 3,330,787 | A | 7/1967 | Denkert | |
| 4,071,913 | A * | 2/1978 | Rector | 2/20 |
| 4,329,741 | A * | 5/1982 | Bach | 2/161.2 |
| 4,624,016 | A | 11/1986 | Luevano | |
| 4,700,405 | A | 10/1987 | Sternberg | |
| 4,748,690 | A * | 6/1988 | Webster | 2/161.1 |
| 4,987,611 | A | 1/1991 | Maye | |
| 5,218,719 | A | 6/1993 | Johnson | |
| 5,253,365 | A * | 10/1993 | Clevenhagen | 2/19 |
| 5,253,367 | A | 10/1993 | Lappley | |
| 5,285,529 | A | 2/1994 | Arena | |
| 5,471,682 | A | 12/1995 | Robins | |
| 5,530,967 | A * | 7/1996 | Cielo | A63B 71/143 2/16 |
| 5,542,126 | A | 8/1996 | Harvanek | |
| 5,551,083 | A * | 9/1996 | Goldsmith | A63B 71/143 2/161.1 |
| 5,557,803 | A | 9/1996 | Granich | |
| 5,604,934 | A | 2/1997 | Willett | |

(Continued)

FOREIGN PATENT DOCUMENTS

| | | |
|---|---|---|
| JP | 2003144599 | 5/2003 |
| JP | 2004181145 | 7/2004 |

*Primary Examiner* — Khaled Annis
(74) *Attorney, Agent, or Firm* — G. Turner Moller

(57) ABSTRACT

A glove liner includes a pad running diagonally across the palm of the hand. When the glove liner is inserted into a baseball fielder's glove, the pad underlies a heel of the glove and/or a palm of the glove and promotes catching a baseball in the webbing or pocket of the fielder's glove.

16 Claims, 1 Drawing Sheet

(56) References Cited

U.S. PATENT DOCUMENTS

| | | | | |
|---|---|---|---|---|
| 5,806,091 | A | 9/1998 | McHugh | |
| 5,815,838 | A | 10/1998 | Lord | |
| 5,855,022 | A * | 1/1999 | Storto | 2/161.2 |
| 5,890,228 | A | 4/1999 | Wagner | |
| 5,896,584 | A | 4/1999 | Hauser | |
| 5,983,397 | A | 11/1999 | Seminara | |
| 6,052,827 | A * | 4/2000 | Widdemer | 2/161.1 |
| 6,088,834 | A | 7/2000 | Seminara | |
| 6,233,744 | B1 | 5/2001 | McDuff | |
| 6,308,331 | B1 * | 10/2001 | Robak | A63B 71/081 2/161.1 |
| 6,708,346 | B2 * | 3/2004 | Terris et al. | 2/161.2 |
| 6,721,960 | B1 * | 4/2004 | Levesque et al. | 2/161.1 |
| 7,003,806 | B1 | 2/2006 | Kleinert | |
| 7,179,180 | B1 | 2/2007 | Frost | |
| 7,431,671 | B1 | 10/2008 | Frost | |
| 7,966,670 | B2 | 6/2011 | Wilbert | |
| 2003/0070209 | A1 * | 4/2003 | Falone | A41D 13/015 2/412 |
| 2005/0155961 | A1 * | 7/2005 | Gilligan | A41D 19/01535 219/211 |
| 2006/0137068 | A1 | 6/2006 | Lomedico | |
| 2006/0218689 | A1 * | 10/2006 | Brown | A63B 71/143 2/19 |
| 2011/0113521 | A1 * | 5/2011 | Bradford | A41D 19/01582 2/19 |
| 2013/0007937 | A1 | 1/2013 | Stone | |
| 2013/0036523 | A1 * | 2/2013 | Webster | A41D 19/01523 2/19 |
| 2013/0145513 | A1 * | 6/2013 | Steiner | A63B 71/143 2/19 |

* cited by examiner

BASEBALL GLOVE AND LINER

This application is based on U.S. Provisional Patent Application 61/849,407 filed Jan. 28, 2013 and U.S. Provisional Patent Application 61/852,970, filed Mar. 26, 2013, priority of which are claimed.

This invention relates to a fielder's glove and liner for the game of baseball.

BACKGROUND OF THE INVENTION

Baseball gloves have been provided with liners to reduce the impact of the ball with the fielder's hands as shown in U.S. Pat. Nos. 4,624,016; 4,987,611; 5,285,529; 5,557,803; 7,966,670 and U.S. Printed Patent Applications 20130007937 and 20130036523. In addition, batter's gloves are quite common as shown in Japanese Patent 2003144599 and U.S. Pat. Nos. 5,218,719; 5,471,682; 5,542,126; 5,604,934; 5,806,091; 5,890,228; 5,983,397; 6,088,834; 7,179,180 and 7,431,671. Similar gloves for golfers are found in Japanese Patent 2004181145 and U.S. Pat. Nos. 2,258,999 and 5,253,367. Of more general interest are U.S. Pat. Nos. RE24610 3,330,787; 4,700,405; 5,815,838; 5,896,584; 6,233,744 and 7,003,806.

SUMMARY OF THE INVENTION

This application discloses a combination baseball fielder's glove and glove liner which improves the ability of the fielder to catch the ball in the pocket or webbing of the glove. The glove liner includes a pad running diagonally across the palm of the fielder's hand. When the fielder places a hand in a more-or-less conventional fielder's glove, the pad is at a location abutting or underlying the heel of the fielder's glove and the fielder's fingers are near the junction of the glove fingers and the center of the glove. With this arrangement, it becomes more difficult to catch the ball on the heel of the glove and easier to catch the ball in the pocket of the glove.

It is an object of this invention to provide an improved baseball glove and liner that improves catching a baseball.

Another object of this invention is to provide a combination baseball fielder's glove and glove liner that promote catching a baseball in the webbing of the glove.

These and other objects and advantages of this invention will become more apparent as this description proceeds, reference being made to the accompanying drawings and appended claims.

DETAILED DESCRIPTION

Figure 1:
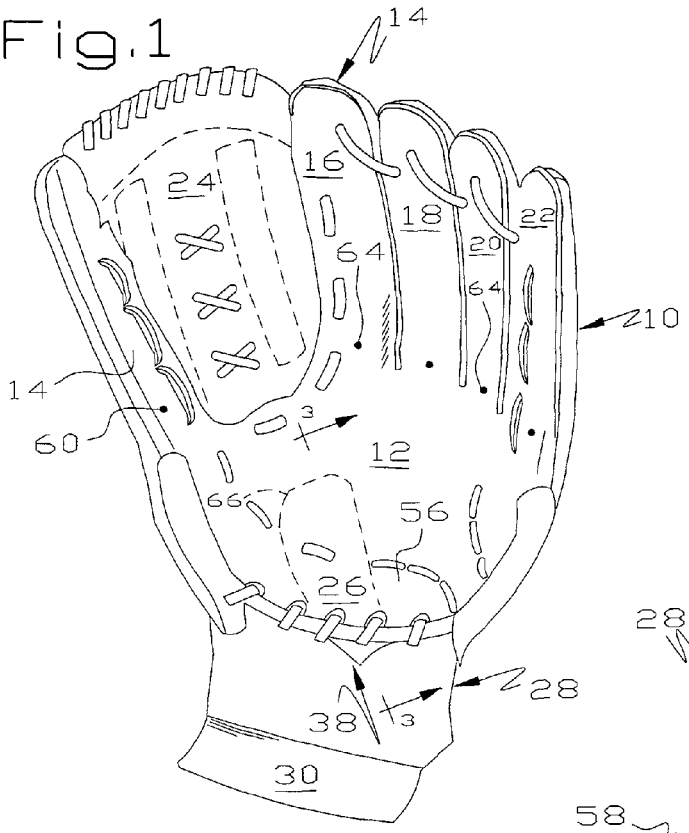
FIG. 1 is a front view of a baseball glove and glove liner on a fielder's hand.

Referring to FIG. 1, a more-or-less conventional baseball fielder's glove 10 may be of any suitable type such as an infielder's glove, an outfielder's glove, a catchers mitt or a first baseman's glove. The glove 10 may include a central or palm portion 12 and a thumb 14 and one or more fingers 16, 18, 20, 22 extending away from the central portion 12. The thumb 14 and fingers 16-22 may be curved but they lie in a common curve or plane. The most desirable place to catch a baseball is in a pocket or webbing 24 between the thumb 14 and index finger 16. A heel or heel pad 26 extends along the bottom of the glove 10. Conventional baseball gloves are made of leather or similar materials. Those skilled in the art will recognize the glove 10 as an infielder's glove for a right handed player.

There is some disagreement in nomenclature of baseball gloves. In this disclosure, the webbing 24 may be referred to as the pocket of the glove 10 whereas some people may use the word pocket to designate an area of the palm 12 adjacent the webbing 24.

A glove liner 28 may comprise a hand shaped device made of leather, vinyl, fabric or similar materials which may be perforated or unperforated. The liner 28 may include a palm section 30, a thumb receiver 32, four finger receivers 34 and a cuff 36. Although the glove liner 28 may be of any suitable type, those skilled in the art will recognize the liner 28 as illustrated to be a modern conventional golf glove.

Figure 2:
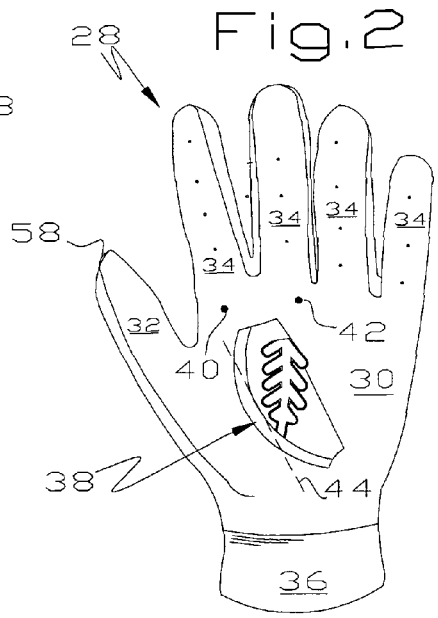
FIG. 2 is a front view of the glove liner on a fielder's hand.
Figure 3:
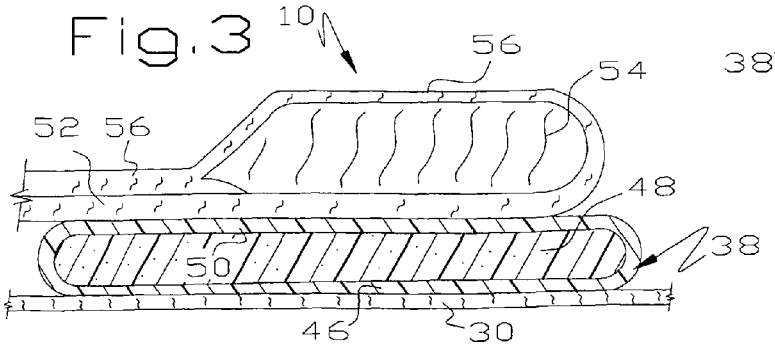
FIG. 3 is a cross-section of the glove of FIG. 1, taken substantially along line 3-3 thereof as viewed in the direction indicated by the arrows.

A single and continuous pad 38 being the only pad on the inner glove liner 28, the pad 38 extending diagonally across the palm section 30 from adjacent a location generally at the base of the user's knuckles of the index and middle fingers to a location generally at the base of the user's palm opposite from the thumb. More specifically, the pad 36 may extend from adjacent the locations 40, 42 which comprise the underside of the player's knuckles of the index and middle fingers. The pad 36 may accordingly reside parallel to or overlying the so-called "life line" on the user's palm shown as a dashed line 44 in FIG. 2. The pad 38 is of considerable thickness when compared to the thickness of the material of the glove liner 28 and is a sizeable fraction of the thickness of the heel 26 of the glove 10 as shown in FIG. 3. The pad 38 may preferably be in the range of 150-300% as wide as of one of the finger receivers 34, when expanded by a finger therein, and may ideally be on the order of 200% of the width of one of the finger receivers 34.

Referring to FIG. 3, the pad 38 may include a layer 46 adhered to the palm 30, a foam layer 48 and a top layer 50 of leather, vinyl, fabric or the like which may be decorated. The pad 38 may connect to the palm 30 of the glove liner 28 in any suitable manner, as by sewing or by adhesives. When in use, the pad 38 abuts a layer 52 of the underside of the heel 26 of the glove 10. The glove 10 includes padding 54 and a layer 56 typically of leather providing the inside surface of the glove 10.

When the user wears the glove liner 28 and inserts the glove hand into the glove 10, the pad 38 underlies the palm 12 and/or heel 26 of the glove 10 and the lower end of the pad 38 may, as shown in FIG. 1, be visible under the glove 10.

Modern baseball gloves are quite large compared to the size of a player's hand. Thus, the thumb of a user extends to about the base of the thumb 14 of the glove 10 and the fingers of a user extend into the glove 10 about to the base of the fingers 16-22. In other words, the tip 58 of the thumb 32 reaches to about the location 60 on the glove 10 and the tips 62 of the fingers 34 reach to about the locations 64 on the glove 10. An outline of the pad 38, projected onto the palm 12 of the glove 10, is shown in dashed line 66 in FIG. 1.

Although the drawings illustrate a glove 10 and liner 28 for a right handed player, it will be apparent that left handed, or mirror image, versions may also provided.

In use, the fielder inserts the glove hand with the liner 28 thereon into the glove 10 as shown in FIG. 1. The pad 38 resides under the glove heel 26. This acts as another heel pad but which extends closer to the pocket or webbing 24 and forces the player to catch a ball more consistently in the pocket 24 as opposed to on the heel 26 or in the palm 12. No one can catch a ball on the heel 26 of a conventional glove. Providing an additional heel pad 38 on the glove liner 26 makes it difficult to catch a ball in the palm 12 so the player learns to catch a ball in the pocket or webbing 24. Thus, the glove liner 28 may be used as a teaching aid or may be used in actual play.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. In combination, a baseball fielder's glove having a central portion, a thumb, at least one finger, the thumb and the at least one finger extending away from the central portion in the same general direction, a webbing between the thumb and the at least one finger, and a heel, the webbing providing a pocket for catching a ball therein; and a hand shaped inner glove liner having a palm portion, a thumb receiver, a series of finger receivers including an index finger receiver and a middle finger receiver and means making it difficult to catch the ball in the glove at a location in the central portion of the glove and make it is easier to catch the ball in the pocket rather than at the location in the central portion of the glove, said means comprising:

a pad extending diagonally across the palm portion along an axis from a junction of the index and middle finger receivers to a location at a base of the palm portion opposite from the thumb receiver, the inner glove liner being received in the baseball fielder's glove with the pad underlying the heel, the pad underlying the location in the central portion of the glove and further being exclusively in a region parallel to the axis, the pad is a single continuous pad being the only pad on the inner glove liner.

2. The combination of claim 1 wherein the series of finger receivers provides exactly four finger receivers.

3. The combination of claim 1 wherein the pad is adhesively secured to the inner glove liner.

4. The combination of claim 1 wherein at least half of the pad lies under the glove heel.

5. The combination of claim 1 wherein the pad has a width dimension in the range of 150-300% of the width of one of the inner glove liner finger receivers.

6. The combination of claim 5 wherein the pad width is on the order of 200% of the width of one of the inner glove liner finger receivers.

7. The combination of claim 1 wherein the heel of the glove is of a predetermined thickness and the pad is greater than half the thickness of the heel of the glove.

8. The combination of claim 1 wherein the pad includes a convexly curved side facing the thumb and intersecting the axis and a straight side generally parallel to the axis and facing a little finger of the inner glove liner.

9. In combination, a baseball fielder's glove having a palm providing a central portion, a thumb, at least one finger, the thumb and the at least one finger extending away from the central portion in a same general direction, a webbing between the thumb and the at least one finger, and a heel; the combination further comprising:

a hand shaped inner glove liner having a palm portion, a thumb receiver, a series of finger receivers providing a width dimension and means making it difficult to catch a ball in the glove at a location in the central portion and make it is easier to catch the ball in the pocket rather than at the location in the central portion of the glove, said means comprising:

a pad extending diagonally across the palm portion, the inner glove liner being received in the baseball fielder's glove with the pad underlying the palm of the glove, the pad having a width dimension of 150-300% of the width of the inner glove liner finger receivers, the pad being in a zone extending diagonally across the palm portion and underlying the location in the central portion of the glove, the pad is a single continuous pad being the only pad on the inner glove liner;

wherein the pad extends diagonally across the palm portion of the inner glove liner along an axis from a junction of the index and middle finger receivers to a location at a base of the palm portion adjacent the heel of the glove.

10. The combination of claim 9 wherein the series of finger receivers provides exactly four finger receivers.

11. The combination of claim 9 wherein the pad is adhesively secured to the inner glove liner.

12. The combination of claim 9 wherein at least half of the pad lies under the glove heel.

13. The combination of claim 9 wherein the pad width is on the order of 200% of the width of one of the inner glove liner finger receivers.

14. The combination of claim 9 wherein the heel of the glove is of a predetermined thickness and the pad is greater than half the thickness of the heel of the glove.

15. The combination of claim 9 wherein the inner glove liner includes a thumb receiver, an index receiver and at least one additional finger receiver and the pad extends diagonally across the palm portion along an axis from adjacent a junction of the index and middle finger receivers to a location at a base of the palm portion opposite from the thumb receiver, the pad including a convexly curved side facing the thumb and intersecting the axis and a straight side generally parallel to the axis and facing a little finger of the inner glove liner.

16. The combination of claim 9 wherein the inner glove liner includes a thumb receiver, an index receiver and at least one additional finger receiver and the pad extends diagonally across the palm portion along an axis from adjacent a junction of the index and middle finger receivers to a location at a base of the palm portion opposite from the thumb receiver, the pad being exclusively in the region parallel to the axis.

* * * * *